United States Patent [19]

De Cloet et al.

[11] Patent Number: 4,520,579

[45] Date of Patent: Jun. 4, 1985

[54] TOBACCO BIN

[75] Inventors: Dan De Cloet; Ben De Cloet, both of Tillsonburg; Ted Krempa, Simcoe, all of Canada

[73] Assignee: De Cloet Ltd., Ontario, Canada

[21] Appl. No.: 504,885

[22] Filed: Jun. 16, 1983

[30] Foreign Application Priority Data

Mar. 9, 1983 [CA] Canada ..... 423246

[51] Int. Cl.[3] ..... F26B 9/06

[52] U.S. Cl. ..... 34/204; 34/212; 34/225; 432/500

[58] Field of Search ..... 432/500; 34/204, 242, 34/225, 233, 236, 191, 212, 237, 196

[56] References Cited

U.S. PATENT DOCUMENTS

| | | | |
|---|---|---|---|
| 3,088,603 | 5/1963 | Boyette . | |
| 3,095,230 | 6/1963 | Long . | |
| 3,143,370 | 8/1964 | Danford et al. . | |
| 3,659,889 | 5/1972 | Whitley . | |
| 3,834,137 | 9/1974 | Long . | |
| 3,888,533 | 6/1975 | Long . | |
| 3,932,946 | 1/1976 | Johnson . | |
| 3,935,959 | 2/1976 | Long . | |
| 3,981,083 | 9/1976 | Danford . | |
| 4,021,928 | 5/1977 | Johnson . | |
| 4,123,221 | 10/1978 | Danford | 432/500 |
| 4,205,455 | 6/1980 | Kihlstedt | 34/191 |
| 4,259,787 | 4/1981 | Minshall et al. . | |
| 4,263,720 | 4/1981 | Bowling | 432/500 |

FOREIGN PATENT DOCUMENTS 751105 1/1967 Canada .

*Primary Examiner*—Larry I. Schwartz

*Attorney, Agent, or Firm*—Banner, Birch, McKie & Beckett

[57] ABSTRACT

A tobacco curing bin for use in a tobacco curing kiln is provided, the said bin comprising a box-like structure with opposing ends, a top, a front, a back, a floor, and having tynes adapted to pierce and support the tobacco leaves therein; each said end being adapted to be impervious to the flow of curing air; the said front being adapted with holes to receive said tynes and having at least one gate to permit loading and unloading of the bin; the said back being adapted to provide a support for the tobacco leaves in the bin when the bin is being loaded or unloaded and further adapted to receive said tynes; the said tynes being adapted to pass through the holes in the front, to pierce the tobacco leaves and to engage with the said back to support the tobacco leaves within the bin; the said floor being adapted to be pervious to the flow of curing air and being characterized in that said floor is adapted to slope upwardly from the ends to a middle portion in said floor to permit an improved flow of curing air through the floor, the tobacco leaves, and out the top of the bin to affect curing of the tobacco leaves therein; each said bin being further adapted to be adjacent to and seal against other like tobacco bins in the kiln to prevent the flow of curing air between adjacent tobacco bins.

23 Claims, 5 Drawing Figures

FIG. 3
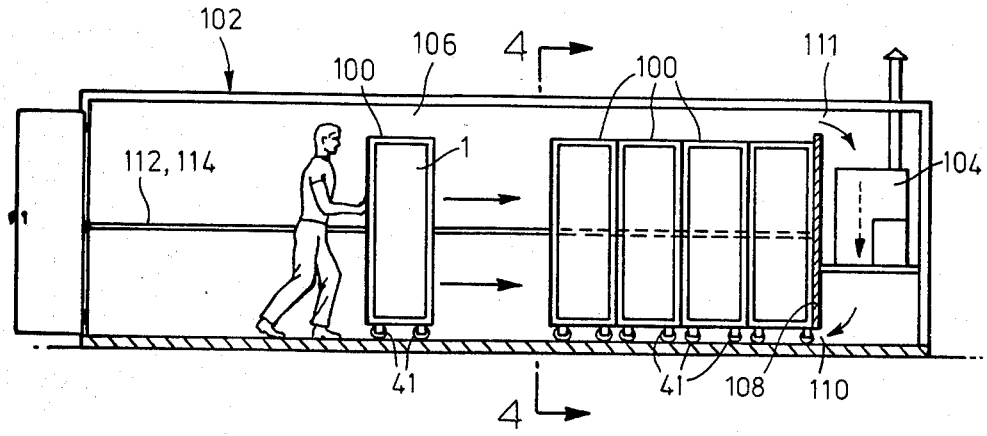
FIG. 4
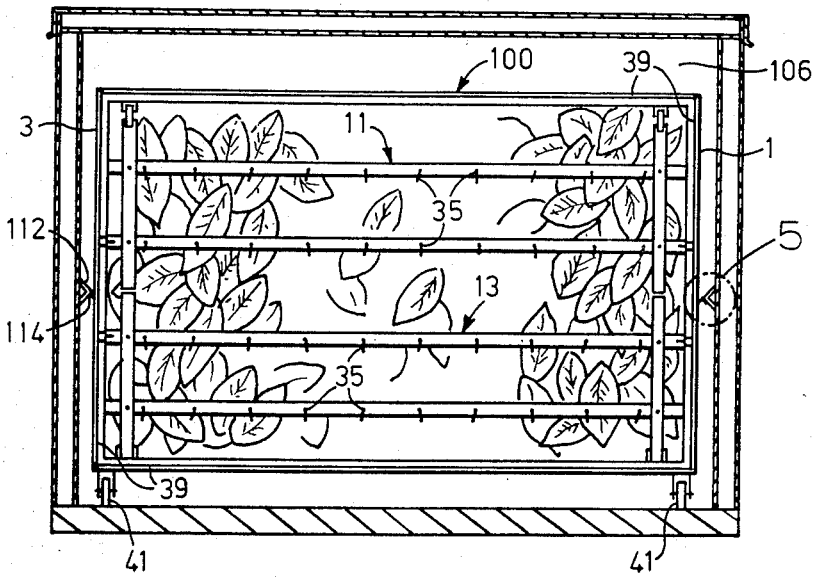
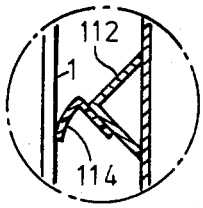
FIG. 5

TOBACCO BIN

This invention relates to an improved container for receiving and treating bulk tobacco leaves in forced air recirculation kilns.

BACKGROUND OF THE INVENTION

Over the past 20 years, revolutionary changes have occurred in the method and apparatus used for harvesting and curing tobacco. These changes have stemmed largely from the development of bulk curing techniques.

Essentially, the bulk curing method involves packing large quantities of tobacco leaves together in a face to face relationship in a heated, forced air recirculation kiln or barn. The leaves are placed so that their surfaces lie in a vertical plane and the heated air is forced upwards through the bulk pack to cure all of the tobacco within. An example of bulk curing methods is disclosed in Hassler Canadian Patent 751,105.

Various methods and means were developed for making bulk packs and for simplifying and mechanizing tobacco harvesting and handling operations. Initially, bulk packing of the tobacco leaves was accomplished by piercing the leaves onto a rack of tynes. An example of such tobacco rack is disclosed in U.S. Pat. No. 3,143,370 to T. J. Danford et al. Harvesters were adapted to this type of rack, for example, see Long U.S. Pat. No. 3,834,137. Loading and unloading mechanisms for handling bulk packed tobacco were also developed, see Long U.S. Pat. No. 3,095,230.

One of the important steps towards the simplification and mechanization of tobacco harvesting and curing was the development of methods and means for curing in large bins. An example of a tobacco container or bin and the related method of curing is disclosed in Long U.S. Pat. No. 3,935,959. In essence the concept is that the tobacco leaves are distributed into a bin with the leaf faces horizontal but otherwise randomly oriented until the bin is filled. During this loading operation the bin lies on its back. Then the bin is closed and the tobacco leaves are pierced through vertically by retaining rods. The bin is then turned so that the back is upright and the leaf faces are vertical. The formation of the bulk pack is maintained by the now horizontal retaining rods. The bin, in this position, with other bins, is then placed in a forced air recirculation kiln. The bottom and the top of the bin are usually perforated or open to permit the circulation of curing air through the bulk packed tobacco.

In the curing of tobacco leaves in large bins or racks, it is especially important to insure the proper air flow throughout the entire curing cycle. As the warm air moves upwardly through the column of leaves, the leaves gradually give up their water content causing them to shrink. The drying and shrinking of the leaves often tends to allow a passage for the curing air along the other edges of the bins, bypassing other leaves, with the result that some of the tobacco leaves are not fully treated.

Various attempts have been made to control the flow of curing air. U.S. Pat. No. 3,932,946, for example, teaches that gas leakage along the side walls caused by shrinkage during curing may be impeded by a flange placed on the side walls. U.S. Pat. No. 4,259,787 also teaches the use of side wall projections to reduce the leakage along the side walls. While these attempts to control the air flow have met with some success, it has been found that nevertheless, it is desirable to have means to provide better control of the air flow throughout the tobacco bin during the entire curing cycle so as to improve the uniformity of treatment of all leaves in the bin.

OBJECT

It is therefore an object of this invention to provide an improved container for receiving and treating tobacco leaves in forced air recirculation kilns.

SUMMARY OF THE INVENTION

The present invention is embodied in a tobacco curing bin for use in a tobacco curing kiln, the said bin comprising a box-like structure with opposing ends, a top, a front, a back, a floor, and having tynes adapted to pierce and support the tobacco leaves therein; each said end being adapted to be impervious to the flow of curing air; the said front being adapted with holes to receive said tynes and having at least one gate to permit loading and unloading of the bin; the said back being adapted to provide a support for the tobacco leaves in the bin when the bin is being loaded or unloaded and further adapted to receive said tynes; the said tynes being adapted to pass through the holes in the front, to pierce the tobacco leaves and to engage with said back to support the tobacco leaves within the bin; the said floor being adapted to be pervious to the flow of curing air and being characterized in that said floor is adapted to slope upwardly from the ends to a middle portion in said floor to permit an improved flow of curing air through the floor, the tobacco leaves, and out the top of the bin to affect curing of the tobacco leaves therein; each said bin being further adapted to be adjacent to and seal against other like tobacco bins in the kiln to prevent the flow of curing air between adjacent tobacco bins.

It is desirable in some embodiments that the floor of the tobacco curing bin have a plurality of louvred openings therein to permit the circulation of curing air through the floor. In the preferred embodiment there is double row of louvred openings adapted to permit curing air from beneath the floor to enter upwards into the bin.

DRAWINGS

In the Figures which illustrate a preferred embodiment of this invention:

FIG. 3 is a sketch of the tobacco bins of this invention being loaded into a curing barn or kiln.

FIG. 4 is a cross-sectional view of the curing barn filled with tobacco bins taken on line 4—4 of FIG. 3.

FIG. 5 is an enlarged view of the sealing means between the end wall of the tobacco bin and the side wall of the curing barn.

In the Figures, like numerals indicate like elements.

Figure 1:
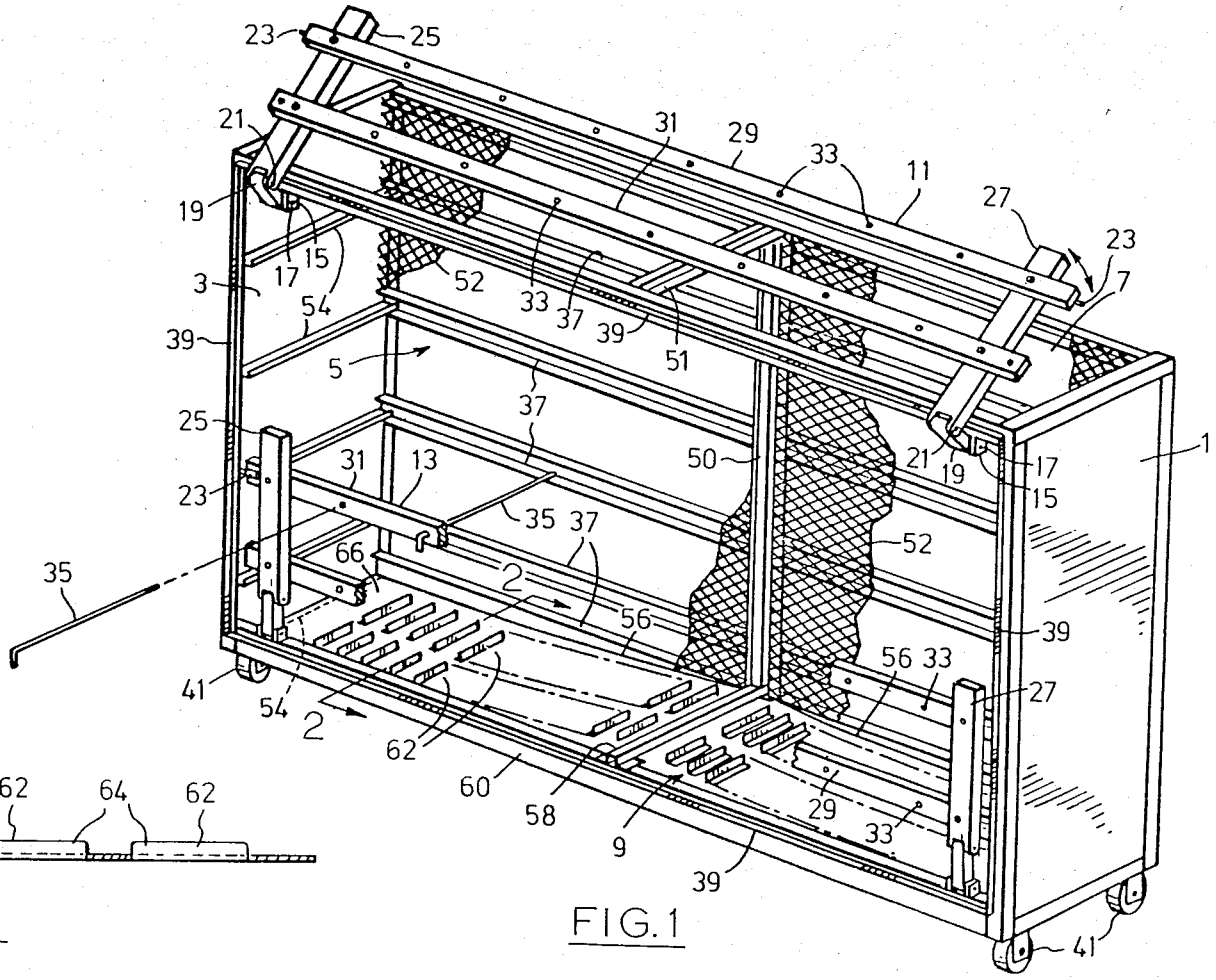
FIG. 1 is a perspective view of the tobacco bin with the upper gate open and the lower gate closed.

The preferred embodiment of the tobacco bin of this invention may be described with references to FIG. 1. As illustrated, the tobacco bin comprises a box structure of tubular steel framing having first and second end walls (1) and (3) respectively, a back (5), a top (7), a floor (9) and a front (10) containing upper and lower gates (11) and (13) respectively. The gates are mounted on the bin frame by means of brackets (15), pivot pins (17), bars (19), and pivot pins (21) to form a double pivoting hinge which permits the gates (11) and (13) to clear the box framework so as to permit them to be opened flat against the top (7) and the underside of the floor (9) respectively. When closed, the gates (11) and (13) fit flush within the end walls (1) and (3) and are locked in place by sliding bolts (23).

Each of the gates (11) and (13) may be constructed as shown in FIG. 1 by vertical tubular steel sections (25) and (27) intersecting two horizontal sections (29) and (31). Each gate is adapted to cover half the front of the bin when closed. Each vertical section (25) and (27) and each horizontal section (29) and (31) has a number of holes (33) drilled through at predetermined intervals to permit the insertion of tynes (35) adapted to pierce the tobacco within the bin. Tynes (35) rest on the steel channels (37) forming the frame of the rear wall (5) or in the open section of the screen mesh (52) which covers the rear wall (5).

The rear wall (5) is made up of a framework of steel channels (37) spanning the width of the rear wall (5), supported centrally by vertical post (50).

The top (7) of the bin has a horizontal supporting beam (51) centrally located but is otherwise open to allow for the free passage of curing air.

The end walls (1) and (3) are solid sheet metal. Within the end walls (1) and (3), flanges (54) protrude into the bin. Flanges (54) provide additional wall strength and when the bin is full of tobacco, are adapted to impede air leakage up along the end walls so that the curing air is forced into and through the bulk packed tobacco within the bin.

The floor (9) of the bin is raised towards the centre from the ends to form an inverted, elongated "V" shaped floor. The floor (9) is made up of two steel panels (56) which are attached to a flange (54) at the bottom of the end walls (1) and (3) and curve upwards and are attached to a top hat strut section (58) spanning the bin centrally between a lower front beam (60) and a lower steel channel (37). The panels (56) rise about 3 inches from the end walls (1) and (3) respectively to the top hat section (58) at the centre of the kiln floor (9). The centrally raised floor (9) improves the air flow characteristics so that the curing air is more centrally distributed through the tobacco in the bin and less likely to leak along the bin ends.

Figure 2:
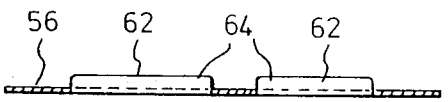
FIG. 2 is a cross-sectional view of the floor of the tobacco bin taken on line 2—2 of FIG. 1.

Along the panels (56) there is a double row of louvred openings (62) adapted to permit curing air from beneath the floor (9) to enter upwards into the bin. The louvred openings (62), best shown in FIGS. 1 and 2, are formed by cutting and bending extended "U" shaped portions (64) of the panels (56) so that they point upwards into the bin. These portions (64) help to stop the tobacco from plugging the louvred openings (62). They also help introduce and direct the air upwards into the tobacco leaves in the bin.

The panels (56) of the bin floor (9) have a solid area (66) without louvred openings (62) adjacent to the end walls (1) and (3) and the front (10), being so adapted to avoid leakage and improve air flow characteristics within the bin.

The bin is mounted on wheels (41) for convenience in moving into and out of the curing barn. See, for example, FIG. 3 which illustrates the tobacco bins (100) being rolled on the wheels (41) into a tobacco curing kiln (102) having a forced air furnace (104) separated from the curing chamber (106) by a partition wall (108) in which there are upper and lower ducts (111) and (110) respectively to permit recirculation of curing air in the conventional way. As shown in FIG. 3, the wheels elevate the floor (9) of the bins (100) when the barn is full. Similarily, the top of the bins (100) are below the ceiling of the curing barn to permit circulation over all the bins (100) back to the forced air furnace (104).

A rubber seal strip (39) is located about the front edges of the end walls (1) and (3), the top (7) and floor (9) of the bins to act as a seal against air passing between adjacent bins in the curing barn.

As shown in FIGS. 4 and 5 the side walls of the curing chamber (106) are adapted with protrusions (112) and the end walls (1) and (3) of the bins (100) are adapted with vinyl strips (114). The protrusions (112) run the length of the curing chamber along the side walls thereof about halfway up the end walls (1) and (3) of the bins (100) and are conveniently made of "V" shaped steel flanges welded to the walls of the curing chamber (102) so that the "V" points upward. The point is rounded for safety and to avoid damage to the bins (100). The vinyl strips (14) are located on the outside surface of the end walls (1) and (3) of the bins (100) so as to be adjacent to the underside of the protrusions (112) and to extend inwardly and downwardly beyond the protrusion (112) when the bins (100) are placed in the curing barn. Thus when bins (100) are juxtaposed to fill the chamber (106), the vinyl strip (114) prevents air leakage up the side of the curing chamber (106) about the end walls (1) and (3) of the bins (100).

It will be apparent to those skilled in the art that many modifications or changes may be made to the constituent elements of this improved tobacco bin without departing from the scope of this invention.

The embodiments of this invention in which an exclusive property and privilege is claimed are as follows:

1. A tobacco curing bin for use in a tobacco curing kiln, the said bin comprising a box-like structure with opposing ends, a top, a front, a back, a floor, and having tynes adapted to pierce and support the tobacco leaves therein;

each said end being impervious to the flow of curing air;

said front having spaced holes to receive said tynes and having at least one pivotally mounted gate to permit loading and unloading the bin;

said back providing a support for the tobacco leaves in the bin when the bin is being loaded or unloaded and further being perforated to receive said tynes;

said tynes passing through said holes in the front, to pierce the tobacco leaves and engage with said back to support the tobacco leaves within the bin;

said floor being pervious to the flow of curing air and being characterized in that said floor slopes upwardly from both said opposing ends to a middle portion in said floor to thereby permit improved flow of curing air through said floor, the tobacco leaves, and out said top of the bin to affect curing of the tobacco leaves therein;

each said end being further adapted to be adjacent to and seal against an inside portion of said kiln to prevent the flow of curing air about the ends of the bin; and said tobacco bin having seal means to seal against other like tobacco bins in the kiln to prevent the flow of curing air between adjacent tobacco bins.

2. A tobacco curing bin as claimed in claim 1 in which said floor is impervious to the flow of curing air for a portion adjacent to said end walls and said front.

3. A tobacco curing bin as claimed in claim 1 in which said floor has a plurality of louvred openings therein to permit the circulation of curing air.

4. A tobacco curing bin as claimed in claim 1 in which said top is open to permit the flow of curing air out of the bin to continue recirculation within the kiln.

5. A tobacco curing bin as claimed in claim 1 in which said back is pervious to the flow of curing air.

6. A tobacco curing bin as claimed in claim 1 in which each of said ends has, on an inside surface thereof, a plurality of flanges attached thereto to impede the flow of curing air along the ends.

7. A tobacco curing bin as claimed in claim 2 in which said floor has a plurality of louvered openings therein to permit the circulation of curing air.

8. A tobacco curing bin as claimed in claim 2 wherein said top is open to permit the flow of curing air out of the bin to continue recirculation within the kiln.

9. A tobacco curing bin as claimed in claim 3 wherein said top is open to permit the flow of curing air out of the bin to continue recirculation within the kiln.

10. A tobacco curing bin as claimed in claim 2 wherein said back is pervious to the flow of curing air.

11. A tobacco curing bin as claimed in claim 3 wherein said back is pervious to the flow of curing air.

12. A tobacco curing bin as claimed in claim 2 in which each of said ends has, on an inside surface thereof, a plurality of generally horizontal flanges attached thereto for impeding the flow of curing air along said ends.

13. A tobacco curing bin as claimed in claim 3 in which each of said ends has, on an inside surface thereof, a plurality of generally horizontal flanges attached thereto for impeding the flow of curing air along said ends.

14. A tobacco curing bin as claimed in claim 7 wherein said top is open to permit the flow of curing air out of the bin to continue recirculation within the kiln.

15. A tobacco curing bin as claimed in claim 7 wherein said back is pervious to the flow of curing air.

16. A tobacco curing bin as claimed in claim 7 in which each of said ends has, on an inside surface thereof, a plurality of generally horizontal flanges attached thereto for impeding the flow of curing air along said ends.

17. A tobacco curing bin for use in forced air recirculation kiln, the said bin comprising a box-like structure with opposing ends, a top, a front, a back, a floor, and having tynes adapted to pierce and support the tobacco leaves therein and wheels on an underside part of said floor to permit the loading and unloading of said tobacco curing bin into and out of said forced air recirculation kiln;

each said end being impervious to the flow of curing air and having on an inside surface thereof a plurality of generally horizontal flanges attached thereto to impede the flow of curing air along the inside surface of said ends;

said top being open to permit the flow of curing air out of the bin to continue recirculation within the kiln;

said front having spaced holes to receive said tynes and having at least one pivotally mounted gate to permit loading and unloading of the bin;

said back being pervious to the flow of curing air and to provide a support for the tobacco leaves in the bin when the bin is being loaded or unloaded and further being perforated to receive said tynes;

said tynes passing through said holes in said front, to pierce the tobacco leaves and to engage with said back to support the tobacco leaves within the bin;

said floor being pervious to the flow of curing air and being characterized in that said floor slopes upwardly from both said opposing ends to a middle portion in said floor to thereby permit improved flow of curing air through said floor, the tobacco leaves, and out said top of the bin to effect curing of the tobacco leaves therein;

each said end having on the outside surface thereof a flexible protrusion being adapted to prevent the flow of curing air around the outside of said tobacco curing bin; and said tobacco curing bins having seal means to seal against other like tobacco curing bins in the kiln to prevent the flow of curing air between adjacent tobacco curing bins.

18. A tobacco curing bin as claimed in claim 17 in which said floor is impervious to the flow of curing air for a portion adjacent to said ends and said front.

19. A tobacco curing bin as claimed in claim 17 in which said floor has a plurality of louvred openings therein to permit the circulation of curing air.

20. A tobacco curing bin as claimed in claim 17 in which said ends, said top, and said floor each have said seal means along a front edge thereof in the form of a sealing strip to prevent the flow of curing air between adjacent tobacco curing bins in the forced air recirculation kiln.

21. A tobacco curing bin as claimed in claim 17 in which said flexible protrusion is in the form of a flexible flat being adapted to seal against an inside portion of said kiln to prevent the floor of curing air about said ends of said tobacco curing bin.

22. A tobacco curing bin as claimed in claim 18 wherein said floor has a plurality of louvered openings therein for the circulation of curing air, and wherein said ends, said top, and said floor each have along a front edge thereof a sealing strip for preventing the flow of curing air between adjacent tobacco curing bins and the forced air recirculation kiln.

23. A tobacco curing bin as claimed in claim 19 in which each of said ends has, on the outside surface thereof, a flexible flap for sealing against an inside portion of said kiln to prevent the flow of curing air about the ends of said tobacco curing bin.

* * * * *